United States Patent [19]

Kaczmarek

[11] 3,981,455

[45] Sept. 21, 1976

[54] DEVICE FOR PROCESSING REFUSE

[76] Inventor: Al Kaczmarek, 2010 Warrenville Road, Lisle, Ill. 60532

[22] Filed: Nov. 29, 1974

[21] Appl. No.: 527,942

[52] U.S. Cl. ..... 241/32; 241/100; 241/152 A; 241/190; 241/DIG. 38

[51] Int. Cl.[2] ..... B02C 13/09

[58] Field of Search ..... 241/DIG. 38, 32, 36, 241/100, 190, 152 R, 152 A, 189 R, 154, 282.1

[56] References Cited

UNITED STATES PATENTS 3,776,474 12/1973 Bassick ..... 241/DIG. 38

3,873,035 3/1975 Benson ..... 241/190 X

*Primary Examiner*—Roy Lake

*Assistant Examiner*—E. F. Desmond

[57] ABSTRACT

A shaft which rotates at high torque and low speed has a plurality of upright plates which are slightly shorter than the inlet funnel in which it is fitted. Stripper fingers in fixed locations protrude towards the shaft and extend between the plates. A wall having a circular arc form emanates from the rear of the inlet funnel and goes over tangentially into a smooth bottom of an outlet chute to which a back pressure device can be connected.

19 Claims, 6 Drawing Figures

DEVICE FOR PROCESSING REFUSE

Figure 1:
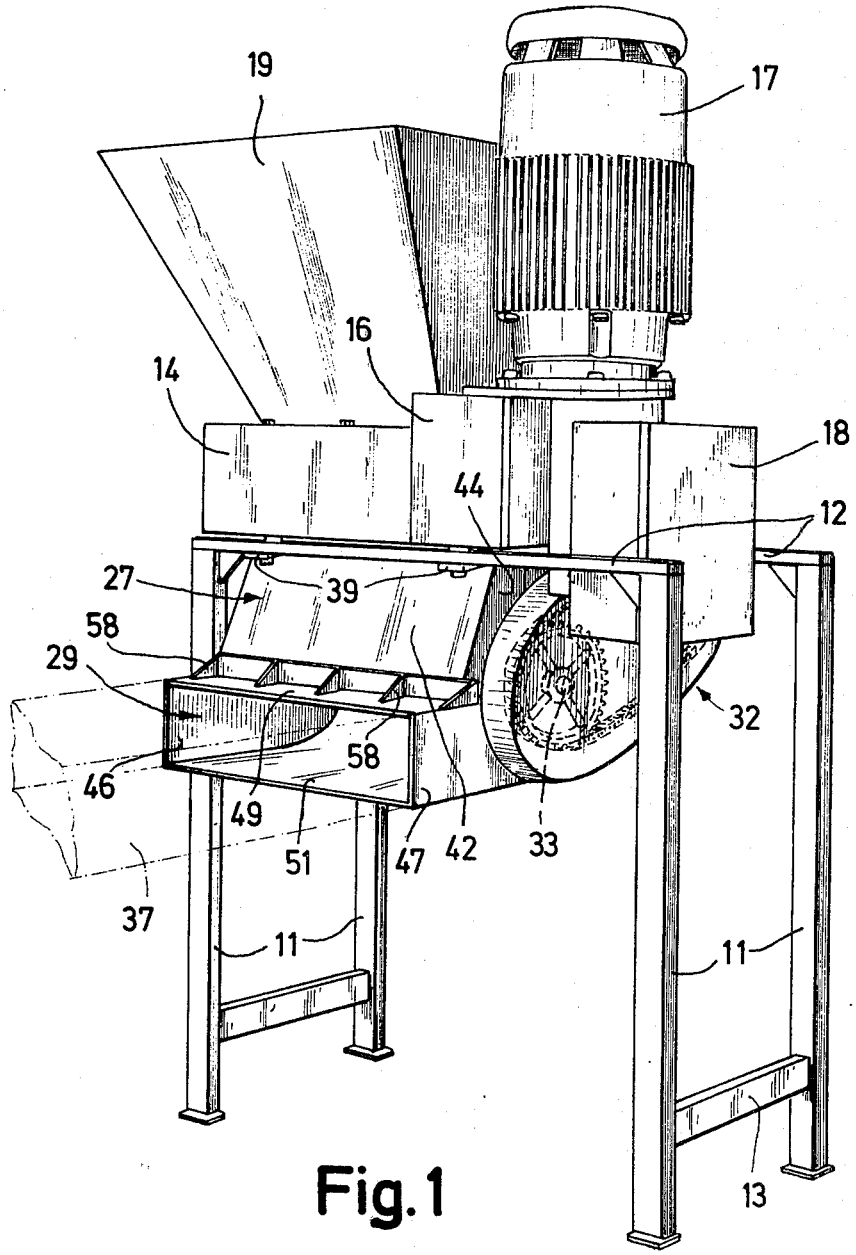

The invention covers a device for processing crushed refuse of varied composition.

Machines, e.g., according to U.S. Pat. No. 3,845,907, can even though they run slowly, crush refuse of many types. For example one can crush tin cans, fruit boxes made of wood, books, automotive batteries, lathe shavings, steel radial tires, glass bottles, television picture tubes etc. With mixed refuse the volume can be reduced 5:1. The refuse coming out of the machine is still loose and has numerous empty spaces. Especially when wooden rods are contained in the mixed refuse, 20 to 40 cm long pieces come out of the machine whose "backbone" has not been broken. These wood fragments can come from beams, boards, boxes etc.

The crushed refuse drops out of the machine into a container. These containers must not be too large because they must fit underneath the machine and must be emptied frequently. This requires expenditure for labor, monitoring etc. It is the purpose of this invention to provide a device which makes possible an additional volume reduction by at least one half for mixed refuse, even when there are long wooden pieces in the mixed refuse, and which device will make it possible to fill large containers over a longer period of time with the even more crushed refuse.

The subject invention solves this problem through the following characteristics:

a. Parallel to the inlet funnel and in its bottom region there is a single shaft driven with high torque and low speed.

b. On the shaft there are mounted rigidly and upright identically shaped bend-resistant plates which are much longer than they are wide.

c. The plates are slightly shorter than the inlet funnel is wide at the shaft level and are spaced a short distance from one another.

d. The shaft is reversible in case of overload.

e. At a level below the shaft there is an outlet chute to which a backwash, back pressure device can be connected.

f. From the rear area (viewed in the direction of rotation of the shaft) of the outlet chute, there are stripper fingers in fixed locations protruding towards the shaft and extending between the plates.

g. A wall whose cross section is a circular arc whose inside is smooth emanating from the rear wall (seen in the direction of rotation of the shaft) of the inlet funnel goes over tangentially into the bottom of the outlet chute.

The device is flange-mounted directly underneath the outlet chute of a reversible crushing machine of low speed and high torque and the device is located with the space between the shaft and the rear wall of the inlet funnel below the refuse exit from the crushing device. As a result, one achieves a compact, dustproof, noiseproof connection between the subject device and the crushing device. In addition, the refuse coming from the crushing device drops onto that area of the plates which move downward. From this type of crushing device, the relatively large wood fragments come out suspended vertically downward. On the statistical average one quickly succeeds in breaking the backbone of these wood fragments in that they are pressed by the plates against the sector and at the same time are moved toward the outlet chute. The straight long wood fragments with their longitudinal shape cannot traverse this path and are therefore broken.

Advantageously, the shaft reverse together with the crushing device. As a result, the crushing device does not deliver material to the subject device when the crushing device reverses. Otherwise a situation would arise where the crushing device operates normally, but the subject device reverses and the inlet funnel of the subject device would be overloaded.

Advantageously, adjacent plates are offset or displaced relative to each other by a constant angle. As a result, the feed of compressed refuse is about the same throughout the width of the outlet chute, and, at the same time, this feeding movement is oscillating throughout the width of the outlet chute. The volume of refuse pushed out from the outlet chute in a certain area always exerts pressure in the exit direction and can no longer expand backwards. This is much better than when only discharging during a certain time interval, and then no longer acting on the refuse volume, and discharging again, etc. Furthermore, the torque to be provided by motor and gear box is distributed quite uniformly over one period of rotation.

Advantageously, the offset or displacement is between 5° and 15° , preferably 10°. As a result, one achieves a great regularity of discharge. By making the angle as indicated, one views, looking into the chute, a relatively thick front of adjacent plates which along a large surface press on the refuse to be discharged so that the refuse package is not merely dented at certain locations, but is actually pushed out.

Advantageously, the plates are two-bladed knives and the sum of the angular displacements is approximately 180°. As a result, one simplifies the arrangement of the plates on the shaft; and per half a resolution of the shaft, only one compacting wave runs from one end of the chute to the other end of the chute. Furthermore, the exiting front is kept wide.

Advantageously, the plates have leading edges (in the shaft rotation direction) which are long, arc-like, steady curvatures (in relation to the plate length) which extend to a peak where they meet with the rear edges of the plates. As a result, one achieves a considerable improvement of the discharge conditions, in comparison with strictly rectangular plates. While the curvatures go in between the stripper fingers, they finally push the compacted refuse out of the outlet chute and this discharge movement finally becomes almost zero when the plate disappears between the associated stripper fingers. Precisely then it has the highest compressive force.

Advantageously, the rear edges of the plates are straight. As a result, one achieves a simple method of manufacturing the plates, the forces in the plates can be computed more easily and one avoids points of discontinuity where the refuse might get stuck. Furthermore, this shape makes it possible to press-punch the plates from rectangular blanks and to keep the punched cut largely free from waste.

Advantageously, the rear edges transition into the curvatures in a continuous manner. As a result, the manufacture is facilitated, the punch die has no protrusions and therefore higher punching times, and the refuse is handled and discharged continuously.

Advantageously, the ratio of the length to the width of the plate is approximately 4:1, with the number 4 variable by ± 10%. As a result, the plates, on the one hand, remain sufficiently wide to withstand the arising torques, and, on the other hand, are sufficiently slender to allow for sufficient room for the refuse between themselves and the walls of the device.

Advantageously, plates with thickness between 15mm and 30 mm, preferably 20 mm; length between 250 mm and 350 mm, preferably 300 mm and width between 50 mm and 100 mm preferably 75 mm, have proven to be of optimum design during experiments.

Advantageously, by means of the speeds of rotation of between 5 and 20 rpm, preferably 12 rpm, it is possible through high gear reduction to provide the high torques necessary for compressing the refuse with the power of the driving motor being relatively low. In addition, this speed takes into consideration that it is better to push out the compressed refuse from the outlet chute with relatively slow but powerful movements than with quick, frequent and relatively weak movements.

Advantageously, the circular arc of the wall emanating from the rear wall of the inlet funnel is about 90°. As a result, one not only allows for the redirection into the horizontal direction, but also for the fact that the wall is sufficiently long to separate the compressed from the non-compressed refuse and one has a sufficiently long distance to accomplish the compression and to break up the wood fragments.

Advantageously, a duct several meters long is connected to the outlet chute as a back pressure or backwash device and has about the same cross section as the mouth of the outlet chute. As a result, one does not require an energy consuming back pressure device per se, but one can use the backwash device to deliver the compressed refuse to the desired location and to use the transmitting resistance of the duct for back pressure.

Alternatively, the back pressure or backwash device consists of a container connected near its bottom to the outlet chute. As a result, one can provide the container as back pressure device so that refuse can be delivered directly from the subject device to the container. This is considerably better than to let the compressed refuse drop into the container, because by dropping the compressed refuse would become loose again.

Figure 2:
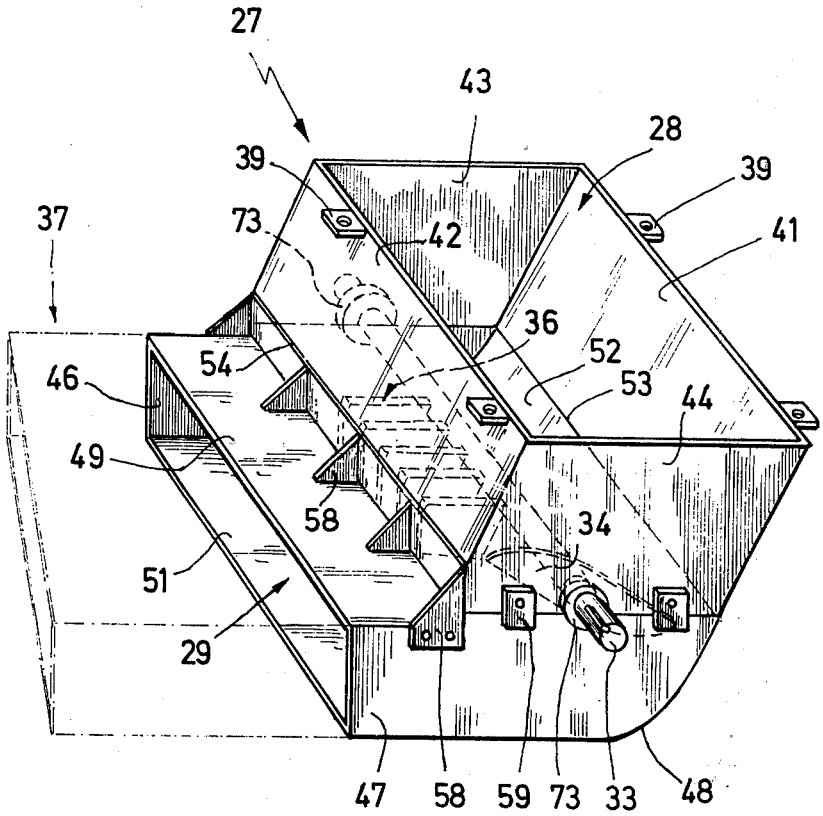
Figure 3:
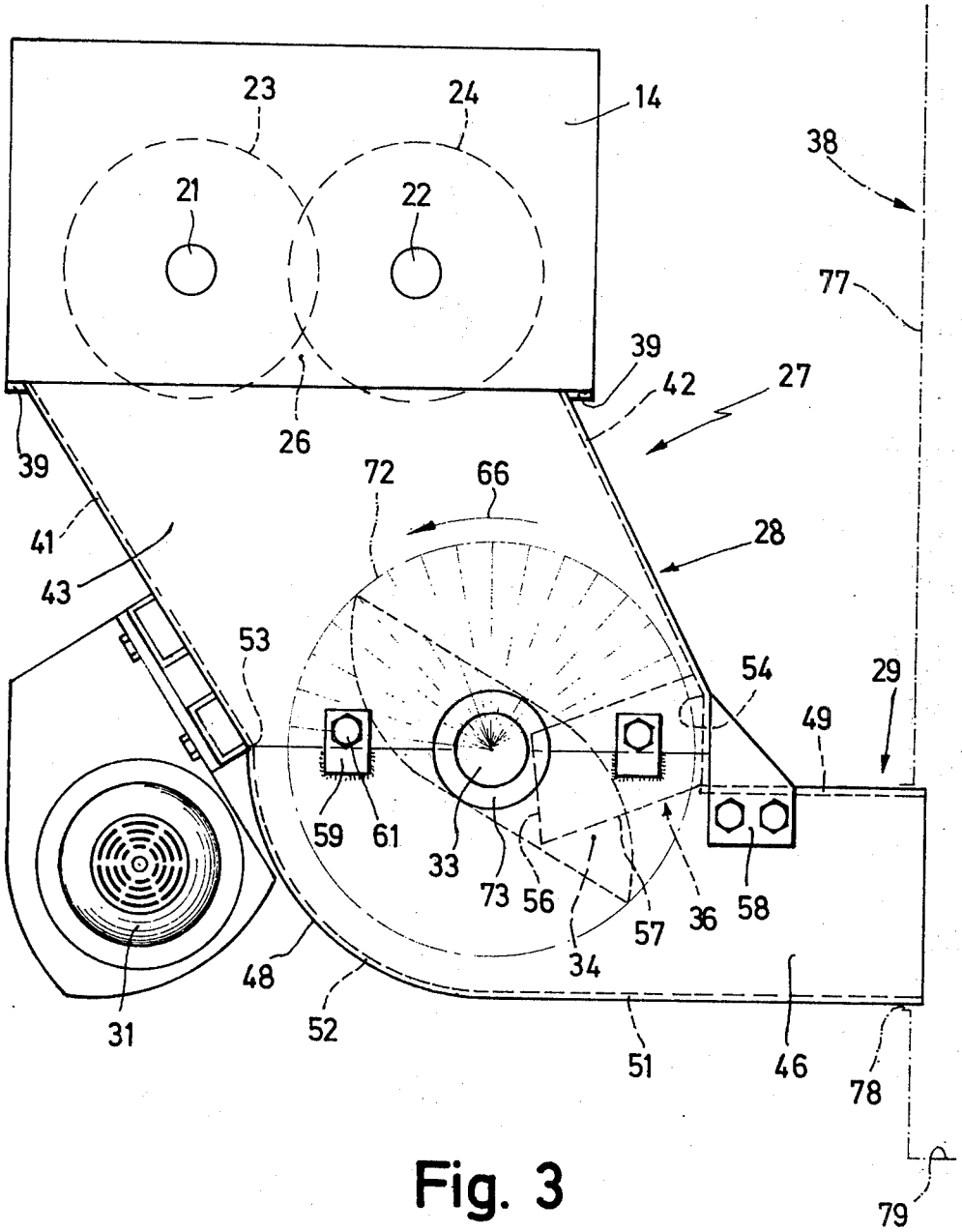
Figure 4:
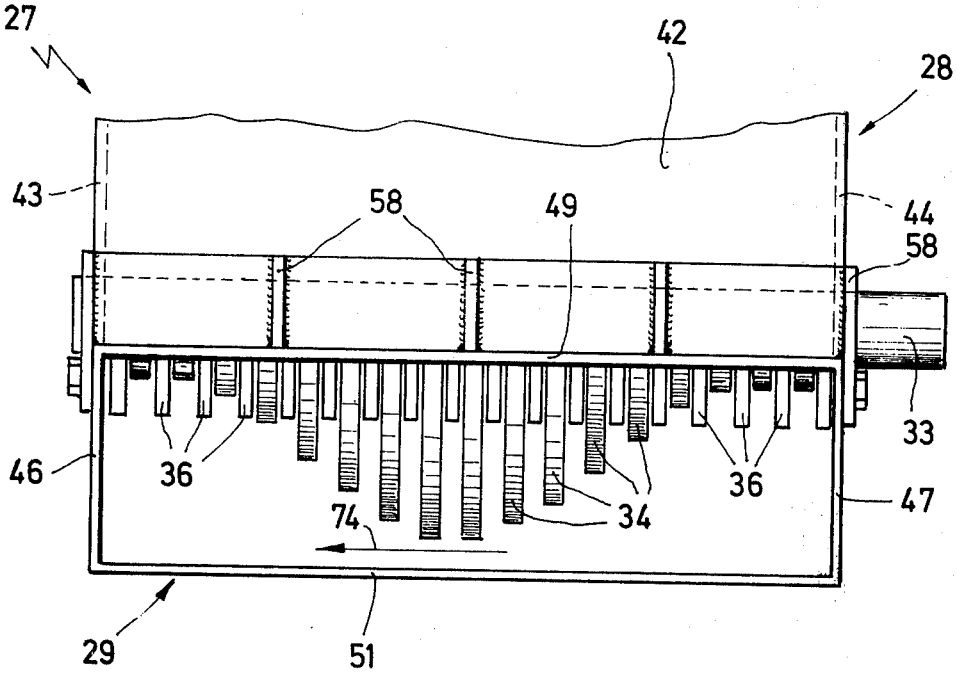
Figure 6:
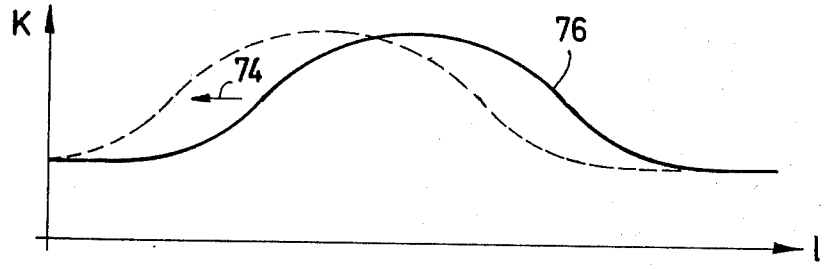
Figure 5:
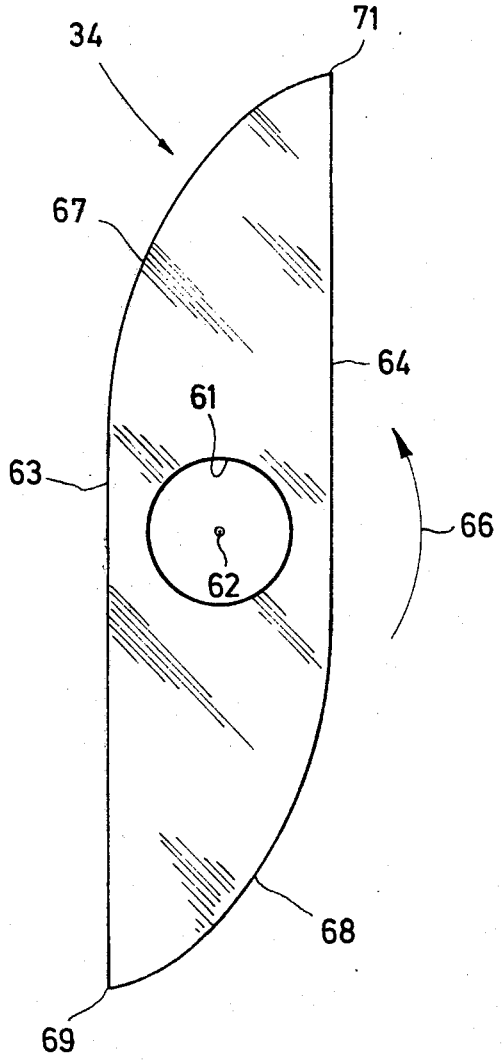

Further advantages and characteristics of the invention are given in the following description of preferred forms of construction. In the drawings FIG. 1 shows a scaled view of a crushing machine below which the device of the subject invention is flanged, and a long pipe connected to the outlet chute, FIG. 2 shows a perspective view of the subject device without reduction device, electric motor and backwash device, FIG. 3 shows the side view of the subject device with electric motor, areas of operation of the knives of the crushing machine and container into which the outlet chute empties, FIG. 4 shows the view into the outlet chute, FIG. 5 shows the side view of an individual plate, exactly to scale 1:2, FIG. 6 shows a diagram indicating the motion of the pressure peak.

A framework, about 1 m high, made of steel tubing has four legs 11, which are connected at the top by cross bars 12. The cross bars 12 are connected by additional bars (not shown) and the legs 11 are connected by bars 13. On top of cross bars 12 is a knife box 14, fixed by screw fasteners. At the right of it is a gear box 16 to which an electric motor 17 is flange-fastened. A switching box 18 is connected to this unit. The fuses are contained in this box. It also contains the means for the reversal, dependent on the current consumption, and the switch relays. A wide funnel 19, open at the top, is fastened to the top of the knife box 14. The knife box contains two horizontal, counter-rotating parallel shafts 21, 22 which are reversible in case of overload, which are shown schematically in FIG. 3. Rigidly connected to these shafts are knives whose dislike shape is indicated by circles 23, 24. Crushed refuse exits at 26 unless a reversal has just been initiated. As shown by FIG. 3, the subject device 27 is fastened directly below the knife box 14 and the circles 23, 24 may even protrude into device 27.

Device 27 essentially contains an inlet funnel 28, an outlet chute 29, an electric motor 31 fastened to device 27 at its backside with flange-fastened reduction gear, a power transmission device 32, a shaft 33, plates 34, stripper fingers 36 and a backwash device 37, 38.

In detail: The inlet funnel has eyelets 39 by means of which it can be screw-fastened below the knife box 14. Its plane backwall 41 makes a 55° angle with the horizontal, its essentially plane front wall 42 makes an angle of about 65° and the side walls 43, 44 are accordingly cut diamond shaped and welded to constitute the inlet funnel 28. Electric motor 31 also is fastened to the inlet funnel 28.

The outlet chute 29 is as wide as the inlet funnel 28. Its side walls 46, 47 pass over in a flush manner into sidewalls 43, 44 and about at an obtuse angle from below. On the whole, they are rectangular and at th back they have a circular curvature 48. However, since the sidewalls 46, 47 have a much smaller height than sidewalls 43, 44 are wide, the outlet cross section of the outlet chute 29 is one-half to one-third that of the cross section of the inlet funnel 28. The top wall 49 of outlet chute 29 is a rectangular plane plate. It extends up to front wall 42. The bottom 51 first runs horizontal and parallel to the top wall 49, is plane and underneath shaft 33 goes over into a backwall 52 which has the shape of a quarter-cylindrical shell and extends up to the bottom side of the rear wall 41. The curvature 48 of sidewalls 46, 47 also follows this configuration. As a result, there develops in the rear wall 41 and rear wall 52 a bend 53 which is best seen in FIG. 3.

In accordance with the number of interspaces between the plates 34, the side view shows rectangular stripper fingers 36 of plate-like configuration welded vertically upright to the front wall 42 in the area of its bend 54 with its right-hand end in FIG. 3. Its left-hand end surface 56 extends barely up to shaft 33, and its lower front surface 57 runs in accordance with FIG. 3 at an obtuse angle towards the bottom left. This can also be seen in FIG. 4.

The lower vertical section of the front wall 42 has the stiffening gussets 58 welded to it; the middle one is also welded to the top wall 49. Welded on lobes 59 and screws 61 are also provided so that everything belonging to outlet chute 29 can be unscrewed.

Plates 34, which are shown most clearly in FIG. 5, have a circular recess 61 through which they are slid onto shaft 33 and there are welded at right angles to it. The diameter is about 50 mm. Around the recess 61 there still is sufficient material to accomodate the torques. In relation to geometric axis 62, the plates 34 are point-symmetrical. Their contour is determined by two parallel straight lines 63, 64 which are approximately 80 mm apart. Since the direction of rotation is according to arrow 66, the straight lines 63, 64 constitute the back of plates 34. The leading edge of plates 34 is formed by circular arcs 67, 68 whose radius is about 75 mm which go over into straight lines 63. 64 at those locations where the straight lines a short distance beyond the center. With an apex angle 69, 71 amounting almost to 90° the arcs 67, 68 go over into the facing straight line 63 or 64 respectively.

The subject invention provides for 17 plates 34 and since the first plate is only 180° and not 360° offset or displaced with the last plate, the angular displacement between adjacent plates 34 is approx 10°. FIG. 3 also shows the circle 72 described by apexes 69, 71. It is evident that the circle 72 runs parallel to the curvature 48 or to the rear wall 52, respectively, approaches it sufficiently close, but not too close. It also is evident that the bend 54 provides approximation to the circular course. The circle 72 approaches this area closer than rear wall 52. The end of the shafts 33 is supported in bearings 73 which are fastened both the inlet funnel 28 and to the outlet chute 29 (not shown here).

FIG. 4 shows to the right of center, plates 34 in their lower position. It is shown that the refuse is pushed out of the outlet chute 29 over a large surface. With further rotation of the shaft 33, this surface runs to the left in accordance with arrow 74. The resulting pressure motion is shown in FIG. 6. The horizontal coordinate is the width of the outlet chute 29 and the vertical coordinate shows the force prevailing in the refuse in outlet chute 29. One clearly notices a pressure peak 76 which, in accordance with arrow 74, as in FIG. 4, travels towards the left, appears again on the right, travels again to the left, etc. It is also evident that the pressure never becomes zero. This may be due to the front surface of the stripper fingers 53 which, because of their oblique position, produce a rectifying effect. Essentially, however, the purpose of the stripper fingers 57 is to prevent the compressed refuse from again entering the inlet funnel 28.

During reversal, the direction of rotation is opposite, refuse is scraped from the outlet chute 29 into the inlet funnel 28, so that the excessive pressure abates. The current through the windings of electric motor 31 is measured. If it exceeds a certain amount, the reversal is started and takes place for 5 or 10 seconds. Afterwards the device runs again in its operation direction. In the form of construction of FIG. 1, the backwash device 37 has the form of a long duct with a correspondingly high flow resistance. This duct may, for instance, lead from a building to a refuse container, to a refuse burner installation or such. Because of its internal resistance it prevents the plates 34 from scraping the refuse loosely out of the outlet chute 29, which happen if no back pressure, backwash device is provided.

In the form of construction according to FIG. 3, the backwash device 38 has the shape of a container. Its wall 77 has a breakthrough 78 which is immediately above the bottom 79. After the refuse has reached a certain level in the container, it exerts a backwash pressure on the outlet chute 29 and the compression starts. However, one can use only containers which are inherently very stable. If they are not, experience teaches us that they are partially pushed apart and deformed by the internal pressure of the compressed refuse.

In the form of construction, the electric motors 17 and 31 are preferably reversed at the same time, depending on whether the drive driven by electric motor 17 requires too much torque or whether the drive driven by electric motor 31 requires too much torque. We are dealing here with an OR function.

I claim:

1. A device for processing refuse of varied composition comprising, inlet means, rotatable shaft means spaced from said inlet means, means for driving said shaft means with high moment and at low speed, a plurality of elongated, bend-resistant plate means rigidly secured to and extending from said shaft means, said plate means being slightly shorter than the depth of said inlet means at the level of said shaft means and being spaced a short distance from one another, means for reversing the rotation of said shaft means in response to overload, outlet means having a bottom at a level below said shaft means and adapted to be connected to back pressure means, a plurality of fixed stripper finger means protruding towards said shaft means and extending, between said plate means from the rear area of said outlet means, wall means of a circular arc in cross section, having a smooth inner surface portion emanating from the rear of said inlet means and transitioning tangentially into the bottom of said outlet means, and means for reversing said shaft means together with reversal of a reversible crushing device.

2. Device according to claim 1 comprising means for flange-mounting said device directly underneath the outlet of a reversible crushing device of low speed and high torque and for locating the space between said shaft means and the rear of said inlet means below the refuse exit from the crushing device.

3. Device according to claim 1, in which each of said plurality of plate means is offset relative to adjacent plate means by approximately the same angle.

4. Device according to claim 3 in which said plate means comprise two-bladed knives and the sum of the angular displacements is approximately 180°.

5. Device according to claim 1 in which said plate means has at least one leading edge and rear edge and has at each of said leading edges in relation to the length of said plate means, a long, arc-like, steady curvature which extends to a peak where the curvature meets a rear edge.

6. Device according to claim 1 in which the ratio of the length to the width of the plate means is approximately 4:1, with the number 4 variable by ± 10%.

7. Device according to claim 1 in which said plate means is press-punched structural sheet steel, unground along its periphery, the thickness of said plate means being between 15 mm and 30 mm, the length of said plate means being between 250 mm and 350 mm and the width of said plate means being between 50 mm and 100 mm.

8. Device according to claim 7 in which the thickness of said plate means is 20 mm; the length of said plate means is 300 mm and the width of said plate means is 75 mm.

9. Device according to claim 1 in which the speed of rotation of said shaft means is between 5 and 20 rpm.

10. Device according to claim 9 in which the speed of rotation is 12 rpm.

11. Device according to claim 1 in which the circular arc of said wall means is about 90°.

12. Device according to claim 1 comprising a back pressure device connected to said outlet means comprising duct means several meters in length which has about the same cross section as said outlet means at its mouth.

13. Device according to claim 1 comprising a back pressure device comprising container means connected near its bottom to said outlet means.

14. A device for processing refuse of varied composition comprising, inlet means, rotatable shaft means spaced from said inlet means, means for driving said shaft means with high moment and at low speed, a plurality of elongated, bend-resistant plate means rigidly secured to and extending from said shaft means, said plate means being slightly shorter than the depth of said inlet means at the level of said shaft means and being spaced a short distance from one another, means for reversing the rotation of said shaft means in response to overload, outlet means having a bottom at a level below said shaft means and adapted to be connected to back pressure means, a plurality of fixed stripper finger means protruding towards said shaft means and extending between said plate means from the rear area of said outlet means, wall means of a circular arc in cross section, having a smooth inner surface portion emanating from the rear of said inlet means and transitioning tangentially into the bottom of said outlet means, each of said plurality of plate means being offset relative to adjacent plate means by approximately the same angle, said plate means comprising two-bladed knives and the sum of the angular displacements being approximately 180°.

15. Device according to claim 14 in which the offset angle is between 5° and 15°.

16. Device according to claim 14 in which the offset angle is about 10°.

17. A device for processing refuse of varied composition comprising, inlet means, rotatable shaft means spaced from said inlet means, means for driving said shaft means with high moment and at low speed, a plurality of elongated, bend-resistant plate means rigidly secured to and extending from said shaft means, said plate means being slightly shorter than the depth of said inlet means at the level of said shaft means and being spaced a short distance from one another, means for reversing the rotation of said shaft means in response to overload, outlet means having a bottom at a level below said shaft means and adapted to be connected to back pressure means, a plurality of fixed stripper finger means protruding towards said shaft means and extending between said plate means from the rear area of said outlet means, wall means of a circular arc in cross section, having a smooth inner surface portion emanating from the rear of said inlet means and transitioning tangentially into the bottom of said outlet means, said plate means having at least one leading edge and rear edge and having at each of said leading edges in relation to the length of said plate means, a long, arc-like, steady curvature which extends to a peak where the curvature meets a rear edge.

18. Device according to claim 17 in which the rear edge is straight.

19. Device according to claim 17 in which the rear edge transitions into said curvature in a continuous manner.

* * * * *